US007262744B2

(12) United States Patent
Zaghloul et al.

(10) Patent No.: US 7,262,744 B2
(45) Date of Patent: Aug. 28, 2007

(54) WIDE-BAND MODULAR MEMS PHASED ARRAY

(75) Inventors: Amir I. Zaghloul, Bethesda, MD (US); Ozlem Kilic, Gaithersburg, MD (US)

(73) Assignee: Comsat Corporation, Clarksburg, MD (US)

( * ) Notice: Subject to any disclaimer, the term of this patent is extended or adjusted under 35 U.S.C. 154(b) by 0 days.

(21) Appl. No.: 10/467,920

(22) PCT Filed: Feb. 14, 2002

(86) PCT No.: PCT/US02/03379

§ 371 (c)(1),
(2), (4) Date: Jun. 21, 2004

(87) PCT Pub. No.: WO02/065578

PCT Pub. Date: Aug. 22, 2002

(65) Prior Publication Data

US 2004/0252059 A1 Dec. 16, 2004

Related U.S. Application Data

(60) Provisional application No. 60/268,620, filed on Feb. 14, 2001.

(51) Int. Cl.
*H01Q 21/00* (2006.01)

(52) U.S. Cl. ..... 343/853; 343/700 MS; 342/368; 342/372

(58) Field of Classification Search ..... 343/700 MS, 343/853; 342/368, 372
See application file for complete search history.

(56) References Cited

U.S. PATENT DOCUMENTS 4,994,813 A * 2/1991 Shiramatsu et al. ..... 342/360
5,293,171 A * 3/1994 Cherrette ..... 343/700 MS
5,488,380 A * 1/1996 Harvey et al. ..... 342/368
5,724,666 A 3/1998 Dent
6,154,176 A 11/2000 Fathy et al.
6,166,705 A 12/2000 Mast et al.
6,366,259 B1 4/2002 Pruett
6,384,797 B1 * 5/2002 Schaffner et al. ..... 343/795

FOREIGN PATENT DOCUMENTS

EP 1 071 161 A 1/2001
JP 7-46023 * 2/1995

* cited by examiner

OTHER PUBLICATIONS

Sanzgiri S, et al. ,"Active subarray module development of rKa band satellite communication systems", Digest of the Antennas and Propagation Society International Symposium, Seattle, Washington, Jun. 19-24, 1994, New York, IEEE, US. vol. 3, Jun. 20, 1994 pp. 860-886., XP010142328, ISBN: 0-7803-2009-3.

*Primary Examiner*—Tho Phan
(74) *Attorney, Agent, or Firm*—Sughrue Mion, PLLC

(57) ABSTRACT

A phased array antenna (100) comprising a planar array having a plurality of modules (101,102,103). Each module comprises an integrated multilayer structure having a plurality of radiating elements (215), at least one of the layers is produced using MEMS technology. Further, each module has at least one of a plurality of phase shifters (220,221,222), a plurality of power dividers (230,231,232), a plurality of polarization circuits (and a plurality of filters (240,241, 242)). The modules are coupled, both mechanically and electrically, to a distribution network (110) for distribution of DC signals and RF signals. At least one amplifier (121, 122,123) is connected between the distribution network and the modules or a single amplifier is connected to the whole array.

19 Claims, 5 Drawing Sheets

Structure of Full Phased Array

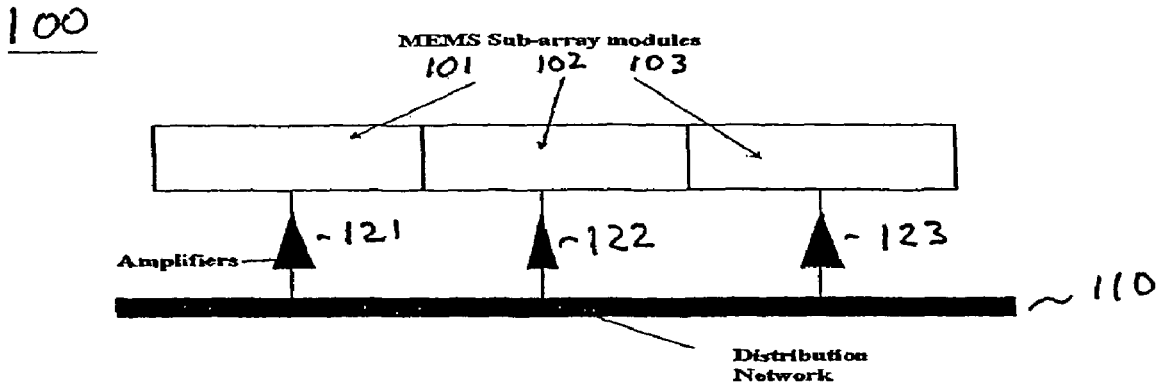
Figure 1A Structure of Full Phased Array

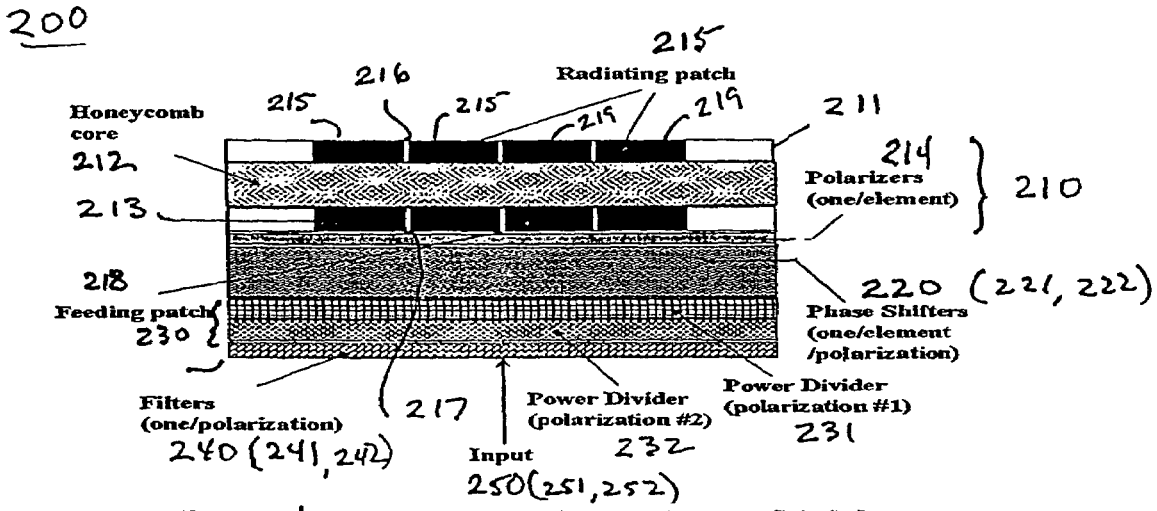
Figure 2A Integrated MEMS Phased Array Module

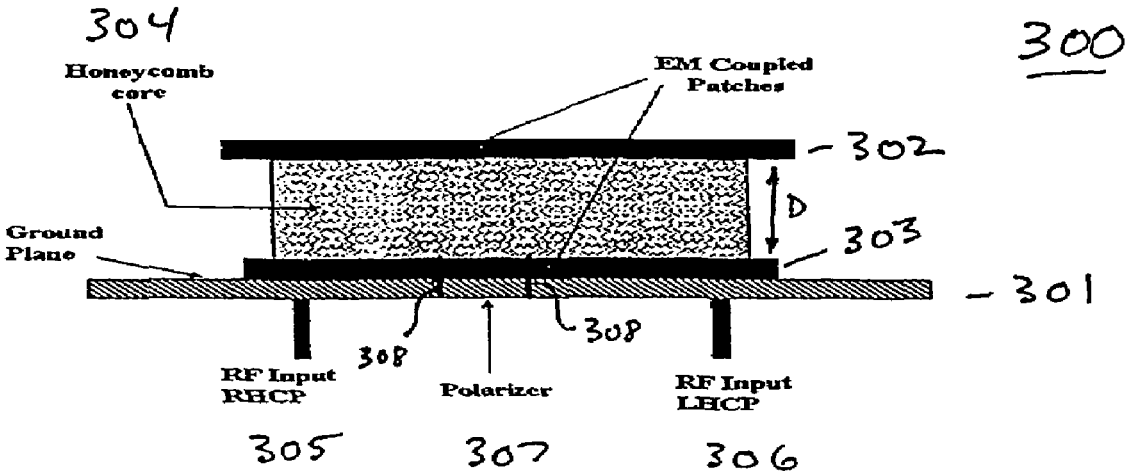
Figure 3 Structure of the EMCP Element

WIDE-BAND MODULAR MEMS PHASED ARRAY

The present application is based on U.S. Provisional Application Ser. No. 60/268,620 filed on Feb. 14, 2001 and priority therefrom is claimed under 35 U.S.C. § 120. The entire content of Provisional Application Ser. No. 60/268,620 is incorporated herein by reference.

BACKGROUND OF THE INVENTION

Active phased arrays with beam scanning capabilities have been in demand for many applications. Radar and on-board satellite antennas are among the applications that already use active phased arrays. For satellite-based antennas, active arrays have been implemented using MMIC components that often use Gallium Arsenide (GaAs) substrates. Two main features limit the widespread use of these arrays: high cost and high losses in the GaAs MMIC substrates that are used in the phase shifters. High losses can translate into higher cost as a result of increasing the array size to combat the losses. Although these features may have been acceptable for satellite-based antennas that are less sensitive to cost, they are not acceptable for ground terminals that are used by the system users to access the satellites. As new non-geostationary satellite systems are proposed for broadband Internet and other applications, the need for low-cost terminals become a dominant factor in the business plan for such systems. Present low cost designs are based on mechanical steering of the antenna, that in most cases use a small reflector as the radiating aperture.

SUMMARY OF THE INVENTION

This invention is a phased array constructed using building blocks of subarray modules that are highly integrated to include radiating elements, and one or more of phase shifters, polarizing circuits and filters. The sub-array is an integration of multiple layers, each layer contributing all or part of a single function or multiple functions. One or more of the layers may be constructed using Micro-Electro-Mechanical System (MEMS) technology. The radiating elements are built in one layer for narrow band operation or two layers using Electro-Magnetically Coupled Patches (EMCP) for wide-band or dual band operation. The polarizer circuit layer provides the feeding and quadrature phase differences to create one or two orthogonal circular polarizations and contains one polarizer per radiating element. The polarizer circuit layer, or even the absence of such layer, may also serve as a basis for providing the feeding for one or two orthogonal linear polarizations. The phase shifter layer contains one phase shifter per each polarization of the radiating element. Two power divider layers, one for each polarization, distribute the power to the sub-array module elements. The filter layers contain one filter for every polarization for the whole module to reject out-of-band signals.

The invention is applicable to both transmit arrays and receive arrays. The power divider layers are operative to act as power combiner layers for the receive array. The complete array is constructed from a plurality of sub-array modules, the number of modules depends on the desired array size. The modular approach allows a uniformly designed and efficiently manufactured module to be used as a building block for different array sizes. In some cases, more t one module design may be used in the full array. The full array may use one amplifier per module, one amplifier for a group of modules, or a single amplifier for the whole array.

BRIEF DESCRIPTION OF THE DRAWINGS

FIG. 1A is a schematic illustration of an array comprising a plurality of sub-array modules.

FIG. 2A is a schematic illustration of an exemplary cross section of a sub-array module.

FIG. 3 is a schematic illustration of an exemplary embodiment in cross section of electromagnetic coupled patches that may form a radiating layer of a sub-array.

DETAILED DESCRIPTION OF THE INVENTION

Figure 1B:
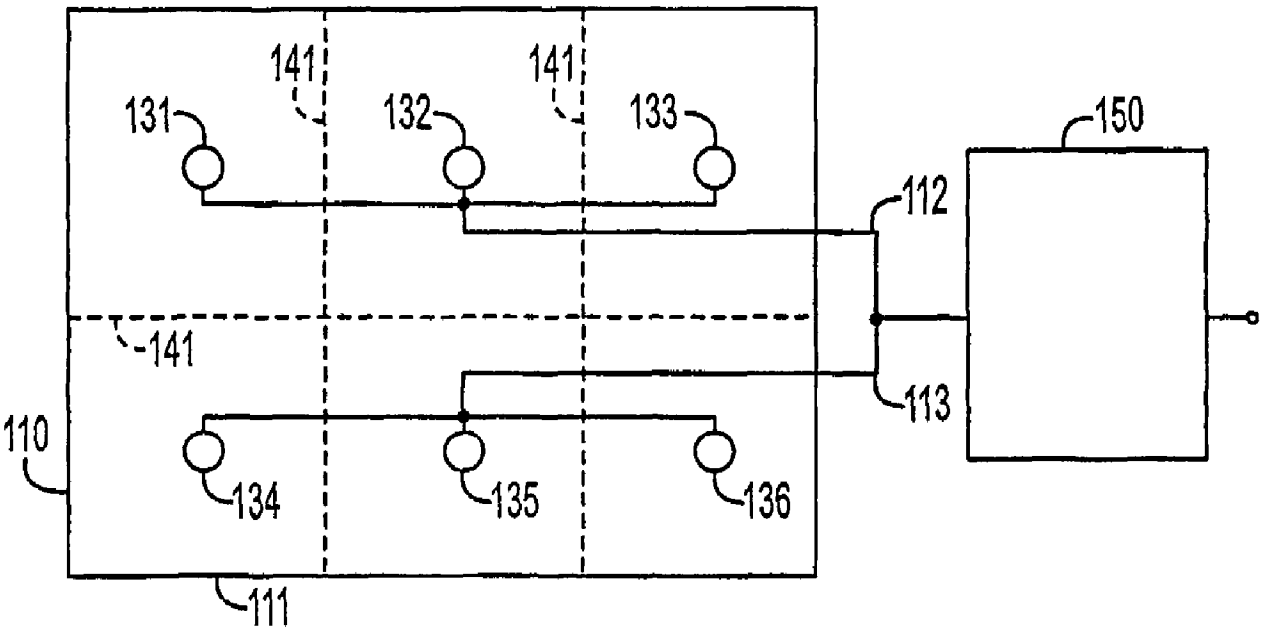
FIG. 1B is a schematic illustration of plan view of the signal distribution network for an array that comprises a plurality of sub-array modules.

A non-limiting but exemplary cross section of a phased array antenna 100, as schematically illustrated in FIG. 1A, consists of a number of sub-array modules 101, 102, 103 that constitute the building blocks of a complete array. While the illustrated cross section of array 100 contains only three modules, an array may contain multiple sub-arrays interconnected into a rectangular, circular or other geometric pattern and forming a planar or conformal structure. The number of modules and number of module designs in an integrated modular array depend on the designed frequency, array size, and system and power distribution requirements. The level of integration will depend on the size of the antenna and complexity of the operational requirements for the array antenna. In the illustrated embodiment, the individual sub-array modules are connected to a distribution network 110 via respective amplifiers 121, 122, 123.

The distribution network 110 is adapted to distribute power, control and communication signals from an external source 150, having appropriate power supplies and control units, as would be known in the art. A plan view of an exemplary but non-limiting embodiment of a distribution network structure for an array antenna with a rectangular shape is illustrated in FIG. 1B. The distribution network, in an exemplary embodiment, includes a support structure 111 made of a non-conductive material and having thereon common conductive paths 112, 113 for both DC control signals and RF power and communication signals from source 150, but separate paths for the two types of signals also may be provided. The RF signals are provided by the path 112, 113 to radiation elements in the individual modules 101, 102, 103 (and three other modules not shown) and the DC control signals may be connected to the individual amplifiers 121, 122, 123 (and three other amplifiers not shown), which may be controlled into an ON or OFF state, or even variable amplification levels, in order to achieve a desired radiation pattern and strength. The distribution network 110 may also be formed with a connector structure 131-136 at the location of each module, in order to provide a secure support for mechanical mounting and electrical connection of the modules into assigned spaces on the array surface. The connection may be made by solder or other well known techniques to provide mechanical and electrical connections. The distribution network structure also may have ridges 141, guides or the like (schematically illustrated as dotted lines) to ensure desired placement and orientation of the modules during assembly, as would be understood by one skilled in the art.

The highly integrated subarray module 200, as illustrated in an exemplary cross sectional embodiment in FIG. 2, is fully or partially fabricated using the micro-electro-mechanical system (MEMS) technology in some of the layers, such as the phase shifter layer. The MEMS technology is an established miniaturization technology that has been developed and driven by the semiconductor industry to create mechanical structures that perform certain electrical, chemical, fluidic or biological functions.

Figure 2B:
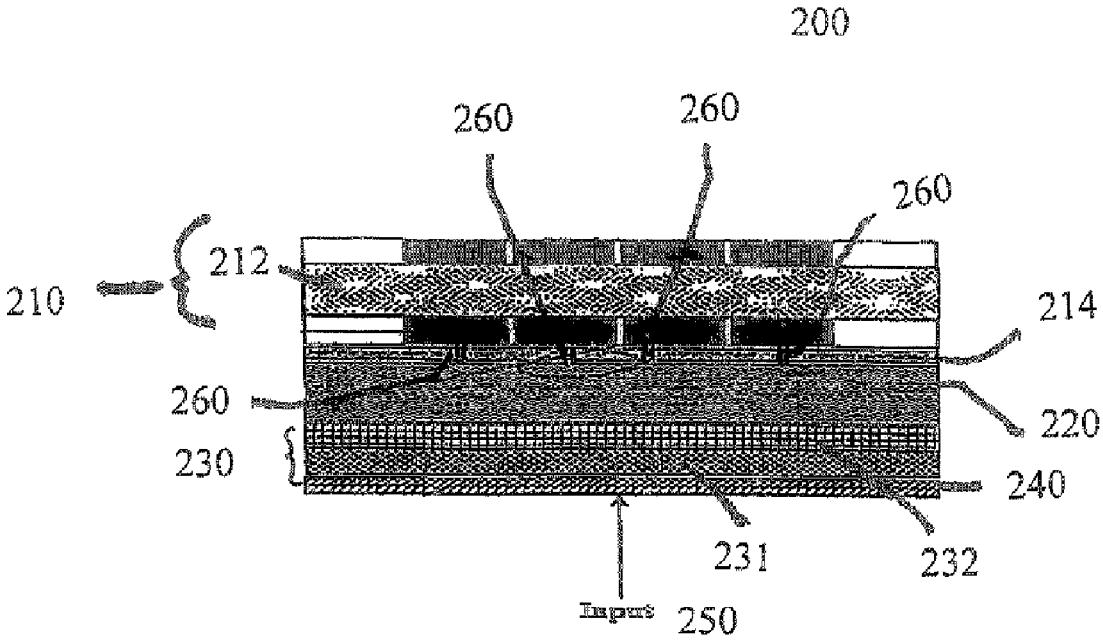
FIG. 2B is a schematic illustration of a cross section of vertical interconnects in an exemplary sub-array module.

Each subarray module 200, as illustrated in FIG. 2A, is a multi-layered structure, which contains an array of wide-band dual polarized radiating elements 210, and at least one of a corresponding number of digital phase shifters 220, (221, 222 for each of two polarizations), a power divider network 230, (231, 232 for each of two polarizations) and a filter 240, (241,242 for each of two polarizations) (right hand circular RHC and left hand circular LHC or two orthogonal linear). In a preferred embodiment, all such layers would be included, but in accordance with the principles of the invention, the radiating elements may be combined with one or more of the other layers 220, 230 and 240, depending on a desired design and capability. As illustrated in FIG. 2B, the various components in the different layers are electrically connected to internal and external structures via vertical interconnects 260 from one layer to another layer and from the distribution network 110, as exemplary illustrated in FIG. 2B. The high level of integration of the radiation layer 210 with one or more of the other layers results in a rugged and power-efficient module, which significantly reduces the cost of phased array antenna systems while improving the overall performance.

The modularity of the sub-array simplifies the integration of plural sub-arrays into a single large phased array 100 that is assembled using the sub-array module as its building block. To produce such assembly, each sub-array module is electrically connected to the distribution network 110 via contacts 131-136 and also may be mechanically connected by the electrical connection and optionally by any of a variety of known mating connectors 141 on the distribution network 110 or on other modules (e.g., tongue and groove—not shown) in order to securely position and maintain them together. The modules may be contained in a peripheral frame or the like, made of plastic, rubber or similar light weight, low cost material that provides the necessary mechanical and electrical properties to enable assembly and use of an array antenna product.

The full phased array 100, as constructed from the appropriate number of the sub-array modules as shown in FIG. 1A, typically comprises identical sub-array module assemblies, or different assemblies that are designed to provide certain capabilities in a part of the full array 100 and different capabilities in another part of the array. For example, where an array is circular, a portion of the array may comprise rectangular modules and another portion may comprise the circumferential curved portions. Also, the modules may differ because different array portions may operate at different frequencies or may provide separate transmission and reception functions. The sub-arrays that are assembled into a full array, whether identical or different, depending on the application, may comprise any of several components integrated in the sub-array module:

A first component is the wide-band radiating element layer 210, which may be assembled as a plurality of multi-layer, wide-band radiating elements, and made using MIC technology. The radiating element layer includes a first (top) radiating patch layer 211, a honeycomb or other separation (support) core layer 212 and a second (bottom) feeding patch layer 213. A polarizer layer 214 is optional and may be considered as part of the layer 210, as it provides one polarizer per radiating element. The top radiating patch layer comprises a plurality of patches 215 that are separated in the same plane by a dielectric 216, which may be air or a material with appropriate dielectric constant. The honeycomb layer 212 may be a continuous layer that acts as a structural support for the construction and assembly of the radiation layers. The bottom feeding patch layer 213 also comprises a plurality of patches 218 that are separated in the same plane by a dielectric 217. The combination of radiating patches, dielectric and feeding patches form a plurality of electromagnetically coupled patch (EMCP) radiating elements 219. In another embodiment the radiating patch and the separation layers may be absent and the feeding patches alone may be designed to serve as the radiating elements 219.

The EMCP is a key element to each sub-assembly and a preferred embodiment is illustrated in FIG. 3. The EMCP element 300 includes a conductive ground plane 301 that supports a first patch 302 and a second patch 303, that is disposed over the first patch and is electrically insulated and physically separated for the first patch 302 by an insulator 304. In a preferred embodiment, the insulator 304 may be a honeycomb plastic structure that has an adequate dielectric constant and thickness in a direction "D" to provide sufficient separation between the two conductive patches 302, 303, in order to enable the proper electromagnetic coupling but prevent electrical conduction.

The EMCP element can provide dual circular or dual linear polarizations, by virtue of the polarizer's RF Input 305 for right hand circular polarization or one sense of linear polarization, and by virtue of the polarizer's RF Input 306 for left hand circular polarization or the orthogonal sense of linear polarization. An input 307 or multiple inputs from a polarizer layer 214, as discussed subsequently, is provided to the ground plane 301 at a surface opposite to that of the patch 303. Vertical interconnects 308 (only two shown for illustrative purposes), would provide an electrical connection from a printed circuit surface of the polarizer to the bottom of the ground plane 301 to the surface of the feed patch 303. Other vertical interconnects also are provided between layers in the subarray module, and are formed as pins, solder filled via's or the like.

The EMPC element with the illustrated design can achieve a low axial ratio for circular polarization or high axial ratio for linear polarization, and the coupled patches in the EMCP element provide enhanced directivity, and also act as resonant elements. The dual resonant structure can be sized to produce a wide bandwidth or two separate narrow bands. A third layer (not shown) can be added to produce three separate bands.

Referring again to the exemplary embodiment of a sub-array module illustrated in FIG. 2, each EMCP 219 is fed with a respective polarization circuit in polarization circuit layer 214 that produces the right phase sequence to the patch elements to produce the right and left hand circular polarizations, or the vertical and horizontal linear polarizations, simultaneously. The two inputs to the polarization circuit constitute the two inputs of the element for the two orthogonal polarizations. The polarization circuits consist of hybrid circuits, as would be well known to one skilled in the art. Dual linear or dual circular polarization can be produced. The structure of this design, as seen in FIG. 2, lends itself to MEMS fabrication. Building the EMCP element in MEMS and integrating it with MEMS phase shifters for beam steering allow for low cost modular production of the complete phased array.

The phase shifter layer 220 consists of a number of phase shifters per polarization (not shown) corresponding to the number of radiating elements 219 in a single module. For a single polarization, there is one phase shifter per element. If two polarizations are required, the number of phase shifters will be two per element. Several MEMS phase shifter designs can be used. The choice is based on the number of phase shifter bits that determine the scanning step of the array, the switching speed and the phase shifter loss. To prevent beam scanning with frequency, a delay line design instead of true phase shift design is used. The delay line design would produce a phase shift that is linearly proportional to frequency. The inputs to the phase shifters are connected to the power divider outputs and their outputs are connected to the two polarizer inputs 305, 306 of the corresponding radiating element 300, as illustrated in FIG. 3.

The power dividing layer 230 comprises two Wilkinson power dividing networks in two layers, 231, 232, as one layer for each polarization is employed in the phased array module. Wilkinson power dividing networks are preferred because the resistive elements in such devices absorb reflective power. Coplanar waveguides can be micromachined on silicon chips to make the Wilkinson power dividers, in a manner well known in the art. The tee junctions, the high impedance transmission lines, and the load polysilicon resistors can be made individually. Thus, the power dividers may result from a direct application of the micromachining process to CMOS. Either single section or double section transmission lines could be utilized to fabricate the power divider. Selection of the number of sections will depend on the bandwidth and insertion loss optimization of the Wilkinson divider. Other designs of the power divider may also be used in the integrated module, especially if reflective power losses can be tolerated. The choice of the power divider design is based on the losses and the ease of integration in the multi-layer structure.

The filter layer 240 comprises two filters, one for each polarization, and constitutes the input layer in the subarray module. The two inputs 250 (251, 252) to the filters are the two inputs for the sub-array module, while the two outputs from the filter layer will be the inputs to the two power dividing networks 231, 232. Several designs can be used for the filter, as is known in the art, and the choice of which depends again on the losses and ease of integration in the multilayer structure.

Although the above description of the invention was for a transmit array, the structural and electrical principles apply also to receive arrays with the same module integration and beam steering ideas. In a receive array, the power dividing circuit formed in layer 230 acts as a power combining circuit. In the full array structure, with reference to FIG. 1, the power amplifiers 110 are replaced with low noise amplifiers. The circuit losses in the different layers will have to be kept to a minimum in order to maximize the receive antenna G/T.

The layers in the phased array module may be constructed in similar or dissimilar materials and media. With reference to FIG. 2, the radiating element layer 210, the polarizer layer 214 and the filter layer 240 may be printed on soft substrates or etched in hard substrates using micromachining or MEMS technology. The phase shifter layer 220, which may contain switches, may also be implemented using soft or hard substrates and using MEMS technology. Vertical interconnections may operate on the different layers although the different layers may not necessarily be of the same material or medium. LTCC (low temperature cofired ceramics) or glass may be used for all layers or only some layers and CMOS or GaAs may be used as the component material The integrated module will be rugged, power efficient and functional under normal environmental conditions, both for transmit and receive arrays.

While the present invention has been described in connection with certain preferred or exemplary embodiments, it is not limited thereto. The full scope of the invention is defined by the claims appended hereto as interpreted in accordance with applicable principles of law.

What is claimed is:

1. A phased array antenna comprising:

an array having a plurality of multilayer modules, each module comprising an integrated multilayer structure having a plurality of radiating elements, and at least one of a plurality of phase shifters, a plurality of power dividers, a plurality of polarization circuits and a plurality of filters;

a distribution network connected to said modules for distribution of DC signals and RF signals to said modules; and at least one amplifier connected between said distribution network and said modules.

2. The phased array antenna of claim 1 wherein said radiating elements are electrically connected to at least one corresponding phase shifter and each said phase shifter is connected to a power divider.

3. The phased array antenna of claim 2 wherein two phase shifters are connected to each radiating element.

4. The phased array antenna of claim 1 wherein said multilayer structure comprises one or more layers built using MEMS technology.

5. The phased array antenna of claim 1, wherein said amplifier is a distributed amplifier, one per module.

6. The phased array antenna of claim 1, wherein said amplifier is a single amplifier for a plurality of modules in said array.

7. The phased array antenna of claim 1 wherein said amplifier is a single amplifier for the whole array.

8. The phased array antenna of claim 1 wherein said module further comprises vertical interconnect structures connecting at least two layers.

9. The phased array antenna of claim 1 wherein at least one layer in said module uses materials different from at least another layer in the multilayer module.

10. The phased array antenna of claim 9 wherein said difference in layer materials is based on use of at least one of soft or hard substrates, microstrip, stripline, and coplanar waveguide transmission medium.

11. The phased array antenna of claim 1 wherein all layers in said multilayer module use same material.

12. The phased array antenna of claim 1 wherein said modules further include vertical interconnects operative to connect at least two layers among said multilayers.

13. The phased array antenna of claim 1 wherein said array comprises one of a transmit and receive phased array.

14. The array of claim 1 comprising a frame constructed to hold in a plane a plurality of said modules.

15. The phased array antenna of claim 1 wherein said power dividers are Wilkinson dividers.

16. The phased array antenna of claim 1 wherein said antenna comprises a frame for holding said plurality of modules.

17. The phased array antenna of claim 1 wherein said antenna comprises a single integrated modular array.

18. An antenna module for an antenna array comprising:

an integrated multilayer structure having a plurality of electromagnetically coupled patch-type radiating elements, and at least one of a plurality of phase shifters, a plurality of power dividers, a plurality of polarization circuits and a plurality of filters, at least one of said plurality of layers comprises a MEMS structure, wherein said radiating elements are electrically connected to at least one corresponding phase shifter and each said phase shifter is connected to a power divider.

19. An antenna module for an antenna array comprising:

an integrated multilayer structure having a plurality of electromagnetically coupled patch-type radiating elements, and at least one of a plurality of phase shifters, a plurality of power dividers, a plurality of polarization circuits and a plurality of filters, at least one of said plurality of layers comprises a MEMS structure, wherein two phase shifters are connected to each radiating element.

* * * * *